US008049549B2

(12) United States Patent
Pigott

(10) Patent No.: US 8,049,549 B2
(45) Date of Patent: Nov. 1, 2011

(54) DELTA PHI GENERATOR WITH START-UP CIRCUIT

(75) Inventor: John M. Pigott, Phoenix, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 12/714,109

(22) Filed: Feb. 26, 2010

(65) Prior Publication Data

US 2011/0210772 A1 Sep. 1, 2011

(51) Int. Cl.
*G05F 1/10* (2006.01)

(52) U.S. Cl. ..... 327/513; 327/539; 327/512

(58) Field of Classification Search ..... 327/539, 327/513

See application file for complete search history.

(56) References Cited

U.S. PATENT DOCUMENTS 5,043,599 A * 8/1991 Zitta ..... 327/65
5,898,323 A * 4/1999 Suda ..... 327/66
5,955,874 A * 9/1999 Zhou et al. ..... 323/315
6,018,235 A * 1/2000 Mikuni ..... 323/313
6,462,587 B2 * 10/2002 Yano ..... 327/89
6,970,124 B1 * 11/2005 Patterson ..... 341/155
7,286,002 B1 * 10/2007 Jackson ..... 327/539
7,495,504 B2 * 2/2009 Kinoshita et al. ..... 327/539
7,554,313 B1 * 6/2009 Leitner ..... 323/315
2008/0007244 A1 1/2008 Draxelmayr
2008/0224682 A1 * 9/2008 Haiplik ..... 323/313
2009/0096510 A1 * 4/2009 Ogiwara et al. ..... 327/539
2009/0206806 A1 * 8/2009 Kamatani ..... 323/273
2010/0181987 A1 * 7/2010 Sicard ..... 323/315

* cited by examiner

*Primary Examiner* — Thomas J Hiltunen
(74) *Attorney, Agent, or Firm* — James L. Clingan, Jr.; Daniel D. Hill

(57) ABSTRACT

A circuit comprises a delta phi generator, a startup circuit, and a level detector. The delta phi generator has a desirable operating state for developing a delta phi voltage at an output node in response to an input voltage, and an undesirable operating state. The startup circuit is coupled to the delta phi generator. The startup circuit ensures that the delta phi generator does not operate in the undesirable operating state. The level detector comprises a comparator with an offset. The comparator has a first input coupled to the output node, a second input coupled to a reference voltage, and an output coupled to the startup circuit. The level detector detects the delta phi voltage, and in response, disables the startup circuit.

14 Claims, 2 Drawing Sheets

DELTA PHI GENERATOR WITH START-UP CIRCUIT

BACKGROUND

1. Field

This disclosure relates generally to circuits that generate a delta phi signal, and more specifically, to delta phi generator having a start-up circuit.

2. Related Art

Bandgap references typically use a circuit that includes a pair of semiconductor devices, biased at different current densities, to generate a voltage across a resistor that is representative of absolute temperature. When the signals are generated using a pair of bipolar transistors this voltage is called a delta Vbe signal. The semiconductor devices can also be PN junction diodes or MOS transistors. Because the voltage can be generated from devices other than those with a Vbe, a more general term that can be used for this signal is a delta phi signal. The delta phi signal or a signal that is generated coincident with the delta phi signal is then used as a key element in generating a voltage reference or some other useful function. One issue with typical delta phi generators is that there may be two stable states and only one of which is useful in generating the delta phi signal. To overcome this a start-up circuit is provided to ensure that the delta phi generator will be in the desired stable state. One of the difficulties with such start-up circuits is in reliably detecting which state the delta phi generator is in especially while using minimal current to perform the detection. Also due to power glitches, the delta phi generator can switch out of the useful state.

Accordingly there is a need to improve upon the techniques for ensuring that the delta phi generator is in the desired state.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

A delta phi generator includes a delta phi core, a start-up circuit, and a level detector. The level detector monitors a delta phi signal generated by the delta phi core to determine if the delta phi core is in the desired stable state. If the delta phi core is not in the desired stable state, the start-up circuit is activated until the delta phi signal has changed indicating that the delta phi is at least in the process of changing to the desired stable state. Use of the delta phi signal is particularly effective because the delta phi signal has a very predictable voltage for the case where the delta phi generator is in the proper state. This is better understood by reference to the drawings and the following written description.

Figure 1:
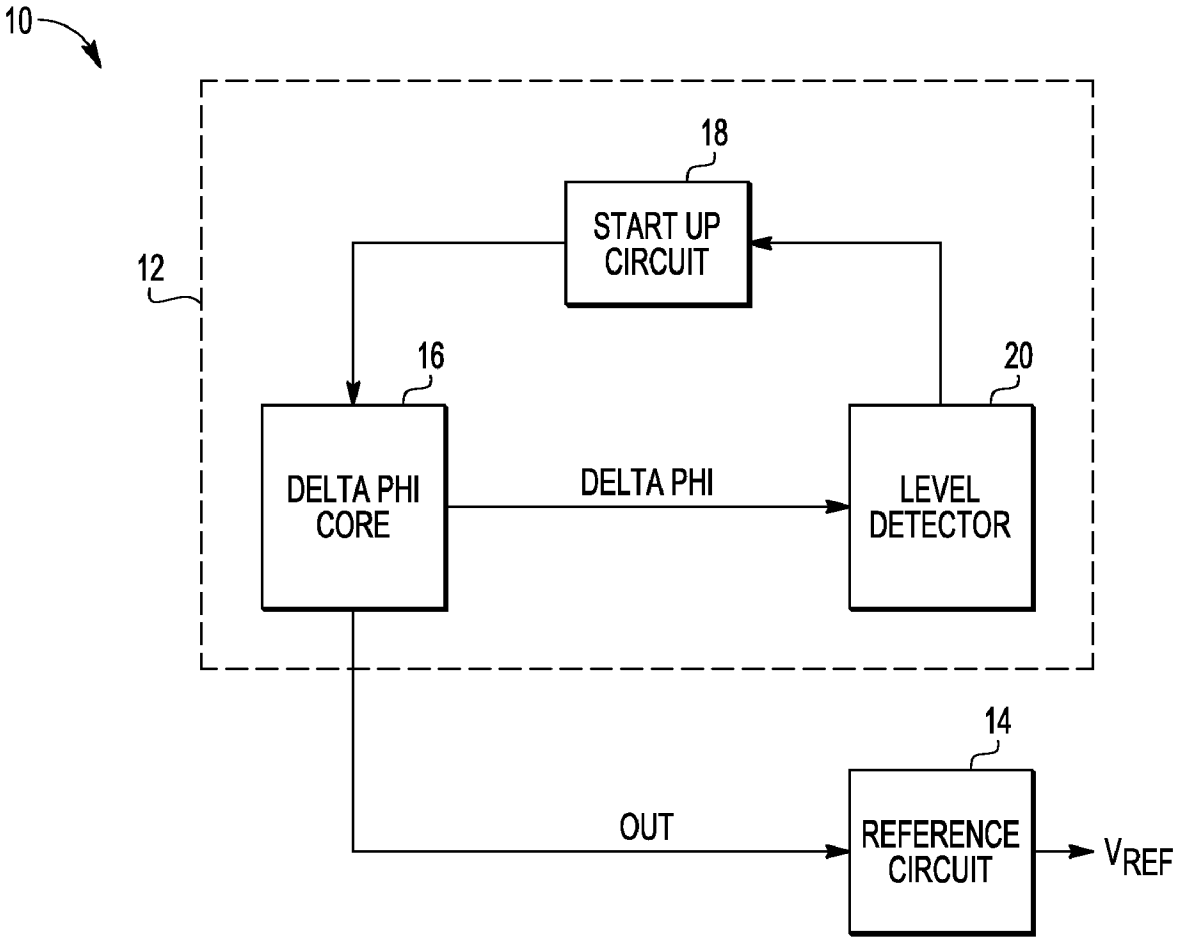
FIG. 1 is a block diagram of a voltage reference generator using a delta phi generator according to an embodiment.

Shown in FIG. 1 is a reference voltage generator 10 comprising a delta phi generator 12 and a reference circuit 14. Delta phi generator 12 includes a delta phi core 16, a start-up circuit 18 having an output coupled to an input of delta phi core 16, and a level detector 20 having an input coupled to an output of delta phi core 16 that generates a delta phi signal and an output coupled to an input of start-up circuit 18. Reference circuit 14 has an input for receiving an output OUT of delta phi generator and an output for providing a voltage reference Vref. The delta phi signal is a voltage signal representative of the absolute temperature. The OUT signal is generated in association with generating the delta phi signal and is also representative of absolute temperature.

In operation, delta phi core 16 has two stable states. Delta phi core 16 is operated using a voltage supply VDD that may be 300 millivolts (mV). When stabilized in the desired stable state, delta phi core 16 provides the delta phi signal at a very predictable voltage such as 40 mV. Level detector 20 detects the voltage level of the delta phi signal and determines if delta phi core 16 is not in the undesired stable state. The undesired stable state is typically at 0 volt but can be somewhat higher than that. If the delta phi signal is above, for example, approximately 20 mV but less than , for example, approximately 40 mV then delta phi core 16, absent an intervening anomaly such as losing power, will reach the desired stable state on its own without requiring further assistance from start-up circuit 18. In such case, a benefit is that it is not necessary to enable start-up circuit 18. On the other hand if the level of the delta phi signal is at zero volts, then delta phi core 16 is in the undesired stable state and may be stuck in the undesired stable state even if the level of the delta phi signal is a little above zero. Thus, if level detector 20 detects that the delta phi signal is below approximately 20 mV, level detector 20 enables start-up circuit 18. In the enabled condition start-up circuit 18 begins providing an output to delta phi core 16 that alters the voltage at a node inside delta phi core 16 so as to cause delta phi core 16 to transition out of the undesired stable state toward the desired stable state. Once the delta phi signal has reached 20 mV, assistance from start-up circuit 18 is no longer needed in the transition from the undesired stable state to the desired stable state. Thus, when level detector 20 detects that the delta phi signal has exceeded approximately 20 mV, level detector 20 disables start-up circuit 18. If at a later time the delta phi signal drops below 20 mV, level detector 20 will detect that fact and enable start-up circuit 18 to ensure that delta phi core 16 is returned to the stable state.

Figure 2:
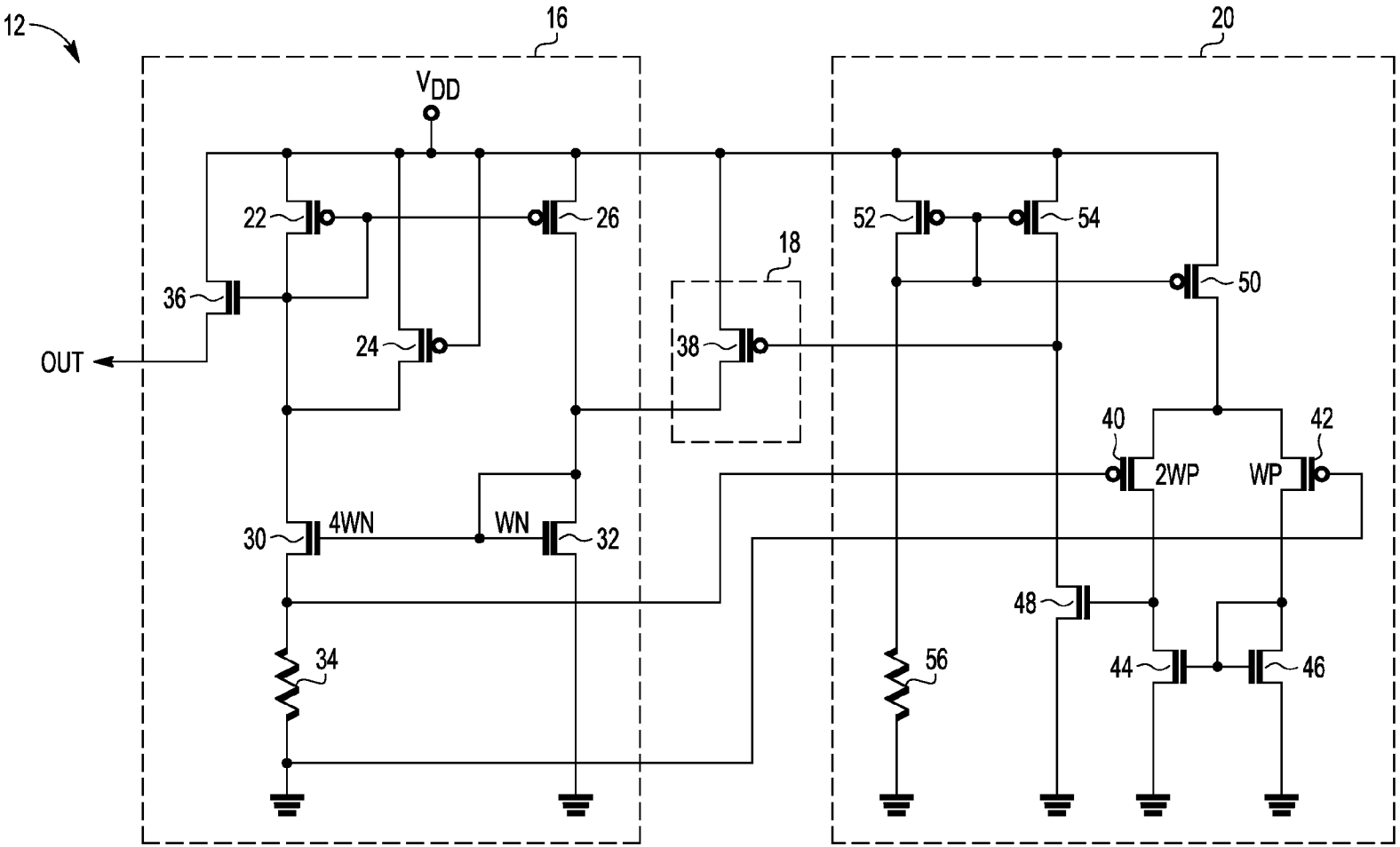
FIG. 2 is a circuit diagram of the delta phi generator of FIG. 1.

Shown in FIG. 2 is a circuit diagram of delta phi generator 12 including delta phi core 16, start-up circuit 18, and level detector 20. Delta phi core 16 comprises P channel transistors 22, 24, 26, and 36; N channel transistors 30 and 32; and a resistor 34. Transistor 22 has a source connected to a positive power supply terminal VDD for receiving a power supply voltage VDD, a gate, and a drain connected to its gate. Transistor 24 has a gate and a source connected to VDD and a drain connected to the drain of transistor 22. Transistor 26 has a source connected to VDD, a gate connected to the gate of transistor 22, and a drain. Transistor 30 has a drain connected to the drain of transistor 22, a gate, and a source. Transistor 32 has a drain connected to the drain of transistor 26, a gate connected to its drain, and a source connected to a negative power supply terminal which in this example is ground. Resistor 34 has a first terminal connected to the source of transistor 30 and a second terminal connected to ground. Transistor 36 has a source connected to VDD, a gate connected to the gate of transistor 26, and a drain that provides the output signal OUT of delta phi core 16. The connection of the source of transistor 30 and the first terminal of resistor 34 is where the delta phi signal is provided. Transistors 22 and 26 are matched. Transistors 30 and 32 are also matched except that transistor 30 has four times, 4WN, the channel width of transistor 32 which has channel width WN. The 4WN width can be conveniently achieved connecting four transistors each of width WN in parallel. Other size ratios of transistor pairs can also be used for the pair consisting of transistor 30 and transistor 32, and the pair consisting of transistor 22 and transistor 26.

Start-up circuit 18 comprises a P channel transistor 38. Transistor 38 has a source connected to VDD, a drain connected to the gate of transistors 30 and 32, and a gate.

Level detector 20 comprises P channel transistors 40, 42, 50, 52, and 54; N channel transistors 44, 46, and 48, and a resistance 56 that may be implemented with a depletion mode N channel transistor. Transistor 40 has a gate connected to the source of transistor 30 for receiving the delta phi signal, a source, and a drain. Transistor 42 has a source connected to the source of transistor 40, a gate connected to the second terminal of resistor 34, and a drain. Transistor 44 has a drain connected to the drain of transistor 40, a gate, and a source connected to ground. Transistor 46 has a drain connected to the drain of transistor 42, a gate connected to its drain and the gate of transistor 44, a source connected to ground. Transistor 48 has a gate connected to the drains of transistors 40 and 44, a drain connected to the gate of transistor 38 which is the input of start-up enable circuit 18, and a source connected to ground. Transistor 50 has a source connected to VDD, a drain connected to the sources of transistors 40 and 42, and a gate. Transistor 52 has a source connected to VDD and a gate and drain connected to the gate of transistor 50. Transistor 54 has a source connected to VDD, a gate connected to the gate of transistor 52, and a drain connected to the drain of transistor 48. Resistance 56 has a first terminal connected to the drain of transistor 52 and a second terminal connected to ground.

In operation when delta phi core 16 is in the desired stable state, transistors 22 and 26 function as a current mirror as do transistors 30 and 32. As in this example where MOS transistors are used for transistors 30 and 32, they typically are operating in a sub-threshold region. The current through transistor 30 also passes through resistor 34 to establish a voltage on the source of transistor 30. The delta phi signal is the voltage differential across resistor 34. With the second terminal of resistor 34 at ground in this example, the voltage at the first terminal of resistor 34 is the delta phi signal which is representative of the absolute temperature. In this case, transistor 36, which is biased at the same conditions as transistors 26 provides the output OUT at a voltage that has the same information concerning the absolute temperature as does the delta phi signal. This operation of transistors 22, 26, 30, 32, and 36 and resistor 34 to produce the delta phi signal and the OUT as representatives of the absolute temperature is well understood in the art for the case where delta phi core is in the desired stable state. The result is that in this condition, the delta phi signal will be very close to 40 mV independent of process variations including variations in the resistance of resistor 34 over the relevant process variations.

For the case of the undesired stable condition, the gates of transistors 22 and 26 are at substantially VDD and the gates of transistors 30 and 32 are at substantially ground. In this condition, none of transistors 22, 26, 30, and 32 are sufficiently conductive to achieve the desired operation. Also in the absence of some other intervening action, the voltages at the gates of these transistors will not change and thus the undesired condition is stable. In this condition, the voltage at the source of transistor 30 is very low, at or near ground due to resistor 34 being connected to ground. With transistor 30 substantially non-conductive, the current through resistor 34 is very low so that the voltage across resistor 34 is very low. A comparator comprised primarily of transistors 40 and 42 is used to detect that the voltage at the source of transistor 30 is below approximately 20 mV. These two transistors have their gates connected across resistor 34 so are using the voltage across resistor 34 for performing a comparison. Transistors 40 and 42 are matched except that transistor 40 has twice the width, 2WP, of transistor 42 which has width WP. Thus for the condition in which there is minimal current through resistor 34, the voltages on the gates of transistors 40 and 42 are substantially the same. Under these conditions the current through transistor 40 will be twice that through transistor 42. With a relatively small current passing through transistor 42 to transistor 46, the gate voltage on transistors 44 and 46 will be relatively low causing transistor 44 to have relatively low conductivity. This causes the drain of transistor 44 to have a relatively higher voltage, especially with relatively high current coming from transistor 40 that must also pass through transistor 44. The relatively higher drain voltage of transistor 44, which is applied to the gate of transistor 48, transistor 48 is relatively more conductive causing transistor 38 to be conductive. This effectively enables the start-up circuit 18. The bias for comparator function of transistors 40 and 42 in combination with transistors 44 and 46 begins with resistance 56 drawing current through transistor 52. This current is mirrored to transistors 50 and 54. The current through transistor 50 is divided based on comparative gate voltages of transistors 40 and 42 and the chosen width ratio of two to one.

In the case of the voltage across resistor 34 being zero, transistor 38 is relatively highly conductive in coupling VDD to the gates of transistors 30 and 32 causing transistors 30 and 32 to become conductive. With transistors 30 and 32 conductive, the drain of transistor 30 is reduced in voltage which causes the gates of transistors 22 and 26 to reduce in voltage which in turn causes transistors 22 and 26 to increase in conductivity. As this continues, the voltage on the source of transistor 30 increases reducing the voltage differential between the gates of transistors 40 and 42. This reduces the current through transistor 40 while increasing it through transistor 42. This has the effect of decreasing the gate voltage on transistor 44 and reducing the current through transistor 44 which reduces the voltage applied to the gate of transistor 48. The reduction in gate voltage on transistor 48 causes an increase in voltage on the gate of transistor 38 which reduces the coupling of VDD to the gates of transistors 30 and 32. As this continues, there will be a point at which the voltage differential between the gates of transistors 40 and 42 will be such that transistor 48 is substantially non-conducive so that transistor 38 provides minimal coupling between VDD and the gates of transistors 30 and 32. This point in this example was chosen to be a differential of 20 mV. When the differential is 20 mV, the source of transistor 30 is 20 mV which is indicative of sufficient current flow through transistor 22 to ensure that the process will continue until the desired stable condition of the delta phi signal being at the voltage of about 40 mV and representative of the absolute temperature. Even when transistor 38 30 becomes disabled, it may provide some leakage current into transistor 32. Transistor 24 is present to provide leakage current to transistor 30 that matches that provided by transistor 38 in the disabled condition. Level detector 20 as shown in FIG. 2 is achieved using a comparator with a selected offset. In this case the comparator inputs are ground and the delta phi signal and the offset, selected to be 20 mV, is achieved by ratioing the input transistors, transistors 40 and 42. Of course the particular values chosen, while effective, could easily be chosen to be something else.

Even though start-up circuit 18 is considered to be disabled by detector 20 during the desired stable condition, level detector 20 is ready to respond to delta phi core 16 reverting to the undesirable stable condition by immediately detecting that the delta phi signal has dropped below 20 mV and enabling start-up circuit 18. Although level detector 20 is continually ready, very little current is required because the circuit is being operated in the subthreshold regime and because transistors 48 and 38 are non-conductive when the level detector detects that the delta phi core is not in the undesirable state.

The embodiment described uses MOS transistors but bipolar devices could also be used. The delta-phi value is important in either case. The delta Phi value depends on the difference in operating voltages (base-emitter voltage in the case of bipolar transistors, and gate-source voltage in the case of FETs) between pairs of devices which are operated at different current densities. These current density differences can be created by having substantially equal currents flowing in devices of different sizes (areas for bipolars, or length/width ratio for FETs), or by having different current values flowing in devices of similar size, or some combination of each.

In the case of bipolar devices, the delta phi value is approximately:

$$\text{delta_phi}=k\cdot T/q\cdot \text{In}(I1*A2/(I2*A1)$$

where k is Boltzmann's constant, T is the absolute temperature, q is the charge on an electron, In( )is the natural log function, I1 and I2 are the currents in each of the devices respectively and A1 and A2 are the relative areas of each device.

In the case of MOSFETs, when the devices are operating with a gate-source voltage lower than the threshold (which is called subthreshold mode), the delta phi value is approximately:

$$\text{delta_phi}=n\cdot k\cdot T/q\cdot \text{In}(I1*L1*W2/(I2*L2*W1)$$

where k, T, q, In( ), I1 and I2 are as above, and L1, L2, W1, and W2 are the relative dimensions of the FETs in the pair. n is an ideality factor which is typically slightly greater than 1.

By now it should be appreciated that there has been provided a circuit including a delta phi generator having a desirable operating state for developing a delta phi voltage at an output node in response to an input voltage, and an undesirable operating state The circuit further includes a startup circuit coupled to the delta phi generator, the startup circuit for ensuring the delta phi generator does not operate in the undesirable operating state. The circuit further includes a level detector comprising a comparator with an offset, the comparator having a first input coupled to the output node, a second input coupled to a reference voltage, and an output coupled to the startup circuit, the level detector for detecting the delta phi voltage, and in response, disabling the startup circuit. The circuit may have a further characterization by which the comparator comprises a first transistor having a first current electrode coupled to a first power supply voltage terminal, a control electrode, and a second current electrode; a second transistor having a first current electrode coupled to the second current electrode of the first transistor, a control electrode coupled to the output node of the delta phi generator, and a second current electrode; a third transistor having a first current electrode coupled to the second current electrode of the second transistor, a control electrode, and a second current electrode coupled to a second power supply voltage terminal; a fourth transistor having a first current electrode coupled to the second current electrode of the first transistor, a control electrode coupled to the second power supply voltage terminal, a second current electrode coupled to the control electrode of the third transistor; and a fifth transistor having a first current electrode coupled to the second current electrode of the fourth transistor, a control electrode coupled to the first current electrode of the fifth transistor and to the control electrode of the third transistor, and a second current electrode coupled to the second power supply voltage terminal. The circuit may have a further characterization by which the offset of the comparator is determined by relative sizing the second, third, fourth, and fifth transistors. The circuit may have a further characterization by which the comparator further comprises a sixth transistor having a first current electrode coupled to the first power supply voltage terminal, a control electrode and a second current electrode both coupled to the control electrode of the first transistor; a seventh transistor having a first current electrode coupled to the first power supply voltage terminal, a control electrode coupled to the control electrode of the first transistor, and a second current electrode coupled to an input of the startup circuit; a resistive element having a first terminal coupled to the second current electrode of the sixth transistor, and a second terminal coupled to the second power supply voltage terminal; and an eighth transistor having a first current electrode coupled to the second current electrode of the seventh transistor, a control electrode coupled to the second current electrode of the second transistor, and a second current electrode coupled to the second power supply voltage terminal. The circuit may have a further characterization by which the startup circuit comprises a sixth transistor having a first current electrode coupled to the first power supply voltage terminal, a control electrode coupled to the output of the level detector, and a second current electrode coupled to the second current electrode of the third transistor. The circuit may have a further characterization by which a control electrode effective width of the second transistor is wider than a control electrode effective width of the fourth transistor. The circuit may have a further characterization by which the offset of the comparator is created by having transistor pairs with different current densities. The circuit may have a further characterization by which the delta phi generator comprises a first transistor having a first current electrode coupled to a first power supply voltage terminal, a control electrode and a second current electrode coupled together; a second transistor having a first current electrode coupled to the second current electrode of the first transistor, a control electrode, and a second current electrode coupled to the output node of the delta phi generator; a resistive element having a first terminal coupled to the second current electrode of the second transistor at the output node, and a second terminal coupled to a second power supply voltage terminal; a third transistor having a first current electrode coupled to the first power supply voltage terminal, a control electrode coupled to the control electrode of the first transistor, and a second current electrode coupled to the control electrode of the second transistor; and a fourth transistor having a first current electrode coupled to the second current electrode of the third transistor, a control electrode coupled to the control electrode of the second transistor, and a second current electrode coupled to the second power supply voltage terminal. The circuit may have a further characterization by which the comparator with an offset comprises one of a group consisting of MOSFET transistor pairs operating in a subthreshold mode and with different current densities and bipolar transistors operating at different current densities to generate the offset.

Also described is a circuit including a first transistor having a first current electrode coupled to a first power supply voltage terminal, a control electrode and a second current electrode coupled together. The circuit further includes a second transistor having a first current electrode coupled to the second current electrode of the first transistor, a control electrode, and a second current electrode. The circuit further includes a resistive element having a first terminal coupled to the second current electrode of the second transistor, and a second terminal coupled to a second power supply voltage terminal. The circuit further includes a third transistor having a first current electrode coupled the first power supply voltage terminal, a control electrode coupled to the control electrode of the first transistor, and a second current electrode coupled to the control electrode of the second transistor. The circuit further includes a fourth transistor having a first current electrode coupled to the second current electrode of the third transistor, a control electrode coupled to the control electrode of the second transistor, and a second current electrode coupled to the second power supply voltage terminal. The circuit further includes a startup circuit coupled to provide a current to the control electrodes of the second and fourth transistors during power up of the circuit. The circuit further includes a level detector comprising a comparator with an offset, the comparator having a first input coupled to the first terminal of the resistive element, a second input coupled to the second terminal of the resistive element, and an output coupled to the startup circuit, the level detector for disabling the startup circuit in response to detecting a predetermined voltage difference between the first and second inputs. The circuit may have a further characterization by which the comparator comprises a fifth transistor having a first current electrode coupled to the first power supply voltage terminal, a control electrode, and a second current electrode; a sixth transistor having a first current electrode coupled to the second current electrode of the fifth transistor, a control electrode coupled to the second current electrode of the second transistor, and a second current electrode. a seventh transistor having a first current electrode coupled to the second current electrode of the sixth transistor, a control electrode, and a second current electrode coupled to the second power supply voltage terminal; an eighth transistor having a first current electrode coupled to the second current electrode of the fifth transistor, a control electrode coupled to the second power supply voltage terminal, a second current electrode coupled to the control electrode of the seventh transistor; and a ninth transistor having a first current electrode coupled to the second current electrode of the eighth transistor, a control electrode coupled to the first current electrode of the eighth transistor and to the control electrode of the seventh transistor, and a second current electrode coupled to the second power supply voltage terminal. The circuit may have a further characterization by which the comparator further comprises a current mirror having an input coupled to the first power supply voltage terminal, a first output coupled to the control electrode of the fifth transistor, and a second output; and a tenth transistor having a first current electrode coupled to the second output of the current mirror, a control electrode coupled to the second current electrode of the sixth transistor, and a second current electrode coupled to the second power supply voltage terminal. The circuit may have a further characterization by which a control electrode width of the sixth transistor is wider than the control electrode width of the eighth transistor. The circuit may have a further characterization by which the startup circuit comprises a fifth transistor having a first current electrode coupled to the first power supply voltage terminal, a control electrode coupled to the output of the level detector, and a second current electrode coupled to the control electrodes of the second and fourth transistors. The circuit may have a further characterization by which the offset of the comparator is created by forming the comparator with transistors having different current densities.

Described also is a circuit including a delta phi generator having a desirable operating state for developing a delta phi voltage at an output node in response to an input voltage, and an undesirable operating state. The circuit also includes a startup circuit coupled to the delta phi generator, the startup circuit for ensuring the delta phi generator does not operate in the undesirable operating state. The circuit also includes a level detector comprising a comparator with an offset. The comparator includes a first transistor having a first current electrode coupled to a first power supply voltage terminal, a control electrode, and a second current electrode; a second transistor having a first current electrode coupled to the second current electrode of the first transistor, a control electrode coupled to the output node of the delta phi generator, and a second current electrode; a third transistor having a first current electrode coupled to the second current electrode of the second transistor, a control electrode, and a second current electrode coupled to a second power supply voltage terminal; a fourth transistor having a first current electrode coupled to the second current electrode of the first transistor, a control electrode coupled to the second power supply voltage terminal, a second current electrode coupled to the control electrode of the third transistor; and a fifth transistor having a first current electrode coupled to the second current electrode of the fourth transistor, a control electrode coupled to the first current electrode of the fifth transistor and to the control electrode of the third transistor, and a second current electrode coupled to the second power supply voltage terminal. The circuit may have a further characterization by which the offset of the comparator is created by providing the first transistor with a different current density from a current density of one a group consisting of the second transistor, the third transistor, the fourth transistor, and the fifth transistor. The circuit may have a further characterization by which the delta phi voltage at the output node is a positive voltage when the delta phi generator is in the desirable operating state, and wherein the delta phi voltage at the output node is equal to about zero voltage when the delta phi generator is in the undesirable operating state. The circuit may have a further characterization by which the comparator further comprises a sixth transistor having a first current electrode coupled to the first power supply voltage terminal, a control electrode and a second current electrode both coupled to the control electrode of the first transistor; a seventh transistor having a first current electrode coupled to the first power supply voltage terminal, a control electrode coupled to the control electrode of the first transistor, and a second current electrode coupled to an input of the startup circuit; a resistive element having a first terminal coupled to the second current electrode of the sixth transistor, and a second terminal coupled to the second power supply voltage terminal; and. an eighth transistor having a first current electrode coupled to the second current electrode of the seventh transistor, a control electrode coupled to the second current electrode of the second transistor, and a second current electrode coupled to the second power supply voltage terminal. The circuit may have a further characterization by which the startup circuit comprises a ninth transistor having a first current electrode coupled to the first power supply voltage terminal, a control electrode coupled to the second current electrode of the seventh transistor, and a second current electrode coupled to the delta phi generator.

Although the invention is described herein with reference to specific embodiments, various modifications and changes can be made without departing from the scope of the present invention as set forth in the claims below. For example, a different approach may be employed for the start-up circuit. For example ground could be coupled to the gates of transistors 22 and 26. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A circuit comprising:

a delta phi generator having a desirable operating state for developing a delta phi voltage at an output node in response to an input voltage, and an undesirable operating state, wherein the delta phi generate comprises a first transistor having a first current electrode coupled to a first power supply voltage terminal, a control electrode and a second current electrode coupled together, a second transistor having a first current electrode coupled to the second current electrode of the first transistor, a control electrode, and a second current electrode coupled to the output node of the delta phi generator, a first resistive element having a first terminal coupled to the second current electrode of the second transistor at the output node, and a second terminal coupled to a second power supply voltage terminal, a third transistor having a first current electrode coupled to the first power supply voltage terminal, a control electrode coupled to the control electrode of the first transistor, and a second current electrode coupled to the control electrode of the second transistor, and a fourth transistor having a first current electrode coupled to the second current electrode of the third transistor, a control electrode coupled to the control electrode of the second transistor, and a second current electrode coupled to the second power supply voltage terminal;

a startup circuit coupled to the delta phi generator, the startup circuit for ensuring the delta phi generator does not operate in the undesirable operating state; and a level detector comprising a comparator with an offset, the comparator having a first input coupled to the output node, a second input coupled to a reference voltage, and an output coupled to the startup circuit, the level detector for detecting the delta phi voltage, and in response, disabling the startup circuit.

2. The circuit of claim 1, wherein the comparator comprises:

a fifth transistor having a first current electrode coupled to the first power supply voltage terminal, a control electrode, and a second current electrode;

a sixth transistor having a first current electrode coupled to the second current electrode of the fifth transistor, a control electrode coupled to the output node of the delta phi generator, and a second current electrode;

a seventh transistor having a first current electrode coupled to the second current electrode of the sixth transistor, a control electrode, and a second current electrode coupled to the second power supply voltage terminal;

an eighth transistor having a first current electrode coupled to the second current electrode of the fifth transistor, a control electrode coupled to the second power supply voltage terminal, a second current electrode coupled to the control electrode of the seventh transistor; and a ninth transistor having a first current electrode coupled to the second current electrode of the eighth transistor, a control electrode coupled to the first current electrode of the ninth transistor and to the control electrode of the seventh transistor, and a second current electrode coupled to the second power supply voltage terminal.

3. The circuit of claim 2, wherein the offset of the comparator is determined by relative sizing the sixth, seventh, eighth, and ninth transistors.

4. The circuit of claim 2, wherein the comparator further comprises:

a tenth transistor having a first current electrode coupled to the first power supply voltage terminal, a control electrode and a second current electrode both coupled to the control electrode of the fifth transistor;

an eleventh transistor having a first current electrode coupled to the first power supply voltage terminal, a control electrode coupled to the control electrode of the fifth transistor, and a second current electrode coupled to an input of the startup circuit;

a second resistive element having a first terminal coupled to the second current electrode of the tenth transistor, and a second terminal coupled to the second power supply voltage terminal; and a twelfth transistor having a first current electrode coupled to the second current electrode of the eleventh transistor, a control electrode coupled to the second current electrode of the sixth transistor, and a second current electrode coupled to the second power supply voltage terminal.

5. The circuit of claim 1, wherein the startup circuit comprises a fifth transistor having a first current electrode coupled to the first power supply voltage terminal, a control electrode coupled to the output of the level detector, and a second current electrode coupled to the second current electrode of the third transistor.

6. The circuit of claim 2, wherein a control electrode effective width of the sixth transistor is wider than a control electrode effective width of the fourth transistor.

7. The circuit of claim 1, wherein the offset of the comparator is created by having transistor pairs with different current densities.

8. The circuit of claim 1, wherein the comparator with an offset comprises one of a group consisting of MOSFET transistor pairs operating in a subthreshold mode and with different current densities and bipolar transistors operating at different current densities to generate the offset.

9. A circuit comprising:

a first transistor having a first current electrode coupled to a first power supply voltage terminal, a control electrode and a second current electrode coupled together;

a second transistor having a first current electrode coupled to the second current electrode of the first transistor, a control electrode, and a second current electrode;

a resistive element having a first terminal coupled to the second current electrode of the second transistor, and a second terminal coupled to a second power supply voltage terminal;

a third transistor having a first current electrode coupled the first power supply voltage terminal, a control electrode coupled to the control electrode of the first transistor, and a second current electrode coupled to the control electrode of the second transistor;

a fourth transistor having a first current electrode coupled to the second current electrode of the third transistor, a control electrode coupled to the control electrode of the second transistor, and a second current electrode coupled to the second power supply voltage terminal;

a startup circuit coupled to provide a current to the control electrodes of the second and fourth transistors during power up of the circuit; and a level detector comprising a comparator with an offset, the comparator having a first input coupled to the first terminal of the resistive element, a second input coupled to the second terminal of the resistive element, and an output coupled to the startup circuit, the level detector for disabling the startup circuit in response to detecting a predetermined voltage difference between the first and second inputs.

10. The circuit of claim 9, wherein the comparator comprises:

a fifth transistor having a first current electrode coupled to the first power supply voltage terminal, a control electrode, and a second current electrode;

a sixth transistor having a first current electrode coupled to the second current electrode of the fifth transistor, a control electrode coupled to the second current electrode of the second transistor, and a second current electrode;

a seventh transistor having a first current electrode coupled to the second current electrode of the sixth transistor, a control electrode, and a second current electrode coupled to the second power supply voltage terminal;

an eighth transistor having a first current electrode coupled to the second current electrode of the fifth transistor, a control electrode coupled to the second power supply voltage terminal, a second current electrode coupled to the control electrode of the seventh transistor; and a ninth transistor having a first current electrode coupled to the second current electrode of the eighth transistor, a control electrode coupled to the first current electrode of the eighth transistor and to the control electrode of the seventh transistor, and a second current electrode coupled to the second power supply voltage terminal.

11. The circuit of claim 10, wherein the comparator further comprises:

a current mirror having an input coupled to the first power supply voltage terminal, a first output coupled to the control electrode of the fifth transistor, and a second output; and a tenth transistor having a first current electrode coupled to the second output of the current mirror, a control electrode coupled to the second current electrode of the sixth transistor, and a second current electrode coupled to the second power supply voltage terminal.

12. The circuit of claim 10, wherein a control electrode width of the sixth transistor is wider than the control electrode width of the eighth transistor.

13. The circuit of claim 9, wherein the startup circuit comprises a fifth transistor having a first current electrode coupled to the first power supply voltage terminal, a control electrode coupled to the output of the level detector, and a second current electrode coupled to the control electrodes of the second and fourth transistors.

14. The circuit of claim 9, wherein the offset of the comparator is created by forming the comparator with transistors having different current densities.

* * * * *